US011591843B2

(12) United States Patent
Lee

(10) Patent No.: US 11,591,843 B2
(45) Date of Patent: Feb. 28, 2023

(54) CONNECTIVE INSTALLATION STRUCTURE FOR MODULARIZED WINDOWS AND DOORS

(71) Applicant: FILOBE CO., LTD, Daegu (KR)

(72) Inventor: Kwang-Seok Lee, Daegu (KR)

(73) Assignee: FILOBE CO., LTD, Daegu (KR)

( * ) Notice: Subject to any disclaimer, the term of this patent is extended or adjusted under 35 U.S.C. 154(b) by 1038 days.

(21) Appl. No.: 16/303,681

(22) PCT Filed: May 25, 2017

(86) PCT No.: PCT/KR2017/005458
§ 371 (c)(1),
(2) Date: Nov. 21, 2018

(87) PCT Pub. No.: WO2017/204573
PCT Pub. Date: Nov. 30, 2017

(65) Prior Publication Data

US 2022/0162900 A1 May 26, 2022

(30) Foreign Application Priority Data

May 25, 2016 (KR) ..... 10-2016-0064364

(51) Int. Cl.
*E06B 1/60* (2006.01)
*E06B 1/56* (2006.01)
(Continued)

(52) U.S. Cl.
CPC ..... *E06B 1/38* (2013.01); *E04B 2/96* (2013.01); *E06B 1/6007* (2013.01); *E06B 3/58* (2013.01)

(58) Field of Classification Search
CPC ..... E06B 1/38; E06B 1/366; E06B 1/6007; E06B 1/02; E06B 1/08; E06B 1/18;
(Continued)

(56) References Cited

U.S. PATENT DOCUMENTS 2,934,798 A * 5/1960 Thyer ..... E06B 1/6007 52/215
2,990,922 A * 7/1961 Rudisill ..... E06B 3/9885 52/204.67
(Continued)

FOREIGN PATENT DOCUMENTS

JP 2015-124487 A 7/2015
KR 10-2007-0083017 A 8/2007
(Continued)

OTHER PUBLICATIONS

English language translation of KR 10-2016-0004112 A (Cited as F1).
(Continued)

*Primary Examiner* — Kyle J. Walraed-Sullivan
(74) *Attorney, Agent, or Firm* — Neifeld IP Law PLLC

(57) ABSTRACT

The present invention relates to a connective installation structure for modularized windows and doors, the connective installation structure successively arranging and connectively installing, in the horizontal direction, modularized sliding windows, doors, or door windows that form the window and doors of a building, with fixed windows arranged in the spaces between the windows and doors. The present invention provides the connective installation structure for modularized windows and doors so as to provide a simplified double frame support structure in which the connective structure lateral section view of the frame, formed by the elevation view of the elements that form the connective installation structure of windows and doors, comprises just (window glass or door panel)-window sash frame-window frame-(fixed window glass), the connective installation structure for windows and doors successively arranging and connectively installing, in the horizontal
(Continued)

direction, the sliding-type windows, doors, or door widows, with fixed windows arranged in the spaces therebetween.

7 Claims, 22 Drawing Sheets

(51) Int. Cl.
*E06B 1/38* (2006.01)
*E04B 2/96* (2006.01)
*E06B 3/58* (2006.01)

(58) Field of Classification Search
CPC ... E06B 1/30; E06B 1/524; E06B 1/56; E06B 1/60; E06B 1/585; E06B 1/5857; E06B 1/5878; E06B 1/64; E06B 2/96; E06B 3/58
USPC ..... 52/204.1, 206, 210, 204.51, 235
See application file for complete search history.

(56) References Cited

U.S. PATENT DOCUMENTS 3,802,127 A * 4/1974 Silvernail ..... E06B 1/38 49/504
3,903,949 A * 9/1975 Aris ..... E06B 3/50 49/455
4,922,666 A * 5/1990 Rotter ..... E06B 3/925 52/632
5,285,606 A * 2/1994 Hagemeyer ..... E06B 1/6007 403/310
6,438,912 B1 * 8/2002 Avent ..... E06B 3/4618 52/800.14
2003/0126812 A1 * 7/2003 Folsom ..... E06B 1/6007 52/204.61
2003/0217523 A1 * 11/2003 Budzinski ..... E06B 1/6007 52/204.5
2005/0284094 A1 * 12/2005 Long ..... E06B 1/6007 52/782.1
2007/0137124 A1 * 6/2007 MacDermott ..... E06B 1/366 52/278
2008/0245000 A1 * 10/2008 Lambertini ..... E05D 15/0686 52/717.02
2015/0233169 A1 * 8/2015 Saunders ..... E06B 1/6007 52/204.7

FOREIGN PATENT DOCUMENTS

KR 10-2011-0053593 A 5/2011
KR 10-2014-0054571 A 9/2014
KR 10-2016-0004112 A 1/2016

OTHER PUBLICATIONS

English language translation of KR 10-2014-0054571 A (Cited as F2).
English language translation of JP 2015-124487 A (Cited as F3).
English language translation of KR 10-2011-0053593 A (Cited as F4).
English language translation of KR 1002007-0083017 A (Cited as F5).

* cited by examiner (1) Cross section - closed (2) Cross section - open (3) Cross section - closed (4) Cross section - open

[a1-a1 section]

[a2-a2 section]

[k2-k2 section]

[k2-k2 section]

[a1-a1 section]

[k3-k3 section]

[k3-k3 section]

[a1-a1 section]

[k4-k4 section]

[k4-k4 section]

[a1-a1 section]

[k5-k5 section]

CONNECTIVE INSTALLATION STRUCTURE FOR MODULARIZED WINDOWS AND DOORS

CROSS REFERENCE TO RELATED APPLICATIONS

This application is a 371 National Stage Entry of PCT/KR2017/005458 filed May 25, 2017, and PCT/KR2017/005458 claims priority to Korean Application 10-2016-0064364, filed May 25, 2016. The contents of Korean Application 10-2016-0064364, filed May 25, 2016, is incorporated by reference in its entirety.

TECHNICAL FIELD

The present invention relates to a connective installation structure for modularized windows and doors for successively arranging and connectively installing modularized sliding windows and door windows or doors to form windows and doors of a building on a wall surface of the building in the horizontal direction with fixed windows arranged in spaces therebetween.

BACKGROUND ART

In general, windows provided for lighting and ventilation of buildings are divided into horizontally sliding windows which are opened or closed in a sliding manner, and hinged windows which are pushed or pulled to be opened or closed in the same manner as doors, according to opening and closing principles thereof.

A sliding window generally forms 2 or more layers of 2 or more window sashes and thus a window frame has a great thickness as exemplarily shown in FIGS. 1 and 2, and, in contrast, a door window forms one layer of one window sash or 2 or more window sashes (in a double open type, not shown) and thus a window frame has a relatively small thickness b or c as exemplarily shown in FIGS. 3 to 6.

When sliding windows (horizontally sliding windows) and door windows (hinged windows) are designed and constructed to be successively arranged in a line in the horizontal direction, it is difficult to finish the surroundings of window frames and to provide an attractive finishing appearance due to a difference between thicknesses of the window frames.

On the other hand, when 2 or more door windows are designed and constructed to be successively arranged in a line in the horizontal direction, thicknesses of window frames applied to the door windows are small, as described above, and thus vulnerability, i.e., low wind pressure resistance, is caused by an overall structure thereof.

Further, when sliding windows (horizontally sliding windows) 10 and door windows (hinged windows) 20 and 30 or doors 40 are designed and constructed to be successively arranged in a line in the horizontal direction, as exemplarily shown in FIGS. 7 to 10, in order to solve a difference between thicknesses of window frames, a frame (blind frame) having a greater thickness employs a structure in which the sliding windows (horizontally sliding windows) 10 and the door windows (hinged windows) 20 and 30 or the doors 40 are inserted into spaces between connection parts of window frames, as exemplarily shown in FIGS. 7 and 8, and, here, when glass is inserted into the blind frame, a curtain wall bar is used instead of the blind frame. Here, the curtain wall bar includes mullions CW-m corresponding to support members in the vertical direction and transoms CW-t corresponding to support members in the lateral direction.

One overall connective structure is formed by inserting the sliding windows 10, and the door windows 20 and 30, such as inward opening (turn and tilt) door windows 20 and outward opening door windows 30 or the doors 40 provided with glass or other kinds of doors panels, which are modularized and independently manufactured, into the frame assembly manufactured using such a blind frame or a curtain wall bar, as exemplarily shown in FIG. 9 (front view), and, as exemplarily shown in FIG. 10 which is a cross-sectional view taken along line k-k of FIG. 9, the respective windows or doors includes window frames 11, 21, and 31 or door frames 41 and window sash frames 12, 22, and 32 and door sash frames 42 installed therein, and thus, a connective structure lateral-sectional view of the frame, formed by the elevations of elements in the connective structure with glass GL of fixed windows arranged therebetween, provides a triple frame support structure including (window glass or door panel)~window sash frame~window frame~curtain wall bar frame~(fixed window glass).

By employing such a triple frame support structure, windows or doors having different thicknesses a, b, c, and d may form one connective structure of the window frames 11, 21, and 31 or the door frames 41 using the blind frame or the curtain wall bar having a thickness e greater than the thicknesses a, b, c, and d of the window frames 11, 21, and 31 or the door frames 41, i.e., the greatest thickness e, and thus provide some degree of unification in the elevations thereof and allows finishing work around the windows and doors to be properly performed.

Such conventional triple frame structure connection technology is advantageous in that structural supplementation is provided in terms of wind pressure resistance and control of vibration due to impact generated when a window sash is opened or closed, but is disadvantageous in that the curtain wall bar including the mullions and the transoms forms a thick elevation and thus provides a poor aesthetic appearance, it is difficult to maximally secure a view through window glass, and additional use of the blind frame or the curtain wall bar reduces economical efficiency.

DISCLOSURE

Technical Problem

The present invention is directed to providing a connective installation structure for windows and doors of a building which may provide excellent unification in the elevations of elements, allow finishing of the windows and doors to be easily performed, maintain structural supplementation in terms of wind pressure resistance and control of vibration due to impact generated when a window sash is opened or closed, form a slim elevation to provide good aesthetic appearance, secure a wide view by minimizing use of a curtain wall bar installed in the longitudinal direction, and be economically advantageous, and, particularly, a connective installation structure for modularized windows and doors in which sliding windows and door windows or doors are successively arranged and connectively installed in the horizontal direction with fixed windows arranged in spaces therebetween and a simplified double frame support structure in which a connective structure lateral-sectional view of a frame, formed by the elevations of the elements forming the connective installation structure of windows and doors, includes only (window glass or door panel)-window sash frame-window frame-(fixed window glass), is provided.

Technical Solution

One aspect of the present invention provides a connective installation structure for modularized windows and doors, which is formed by successively arranging and connectively installing modularized sliding windows and door windows or doors for exit and entrance in the horizontal direction with fixed windows arranged in spaces therebetween, glass side surface installation units configured to fixedly install side surface parts of window glass of the fixed windows installed in the spaces between the sliding windows and the door windows or the doors are directly provided on transverse outer surfaces of window frames or door frames forming outer perimeters of window sash frames or door sash frames constituting the sliding doors and the door windows or the doors, first transverse curtain wall connection members and second transverse curtain wall connection members configured to respectively fix upper ends and lower ends of the window glass of the fixed windows installed in the spaces between the sliding windows and the door windows or the doors are provided, fixing units configured to fixedly connect the first transverse curtain wall connection members and the second transverse curtain wall connection members to upper end parts and lower end parts of the transverse outer surfaces of the window frames or the door frames forming the outer perimeters of the window sash frames or the door sash frames are provided, and glass upper and lower part installation units configured to fixedly install upper and lower parts of the window glass of the fixed windows installed in the spaces between the sliding windows and the door windows or the doors on lower surfaces of the first transverse curtain wall connection members and upper surfaces of the second transverse curtain wall connection members are provided.

The window frames or the door frames of the sliding doors and the door windows or the doors may be set to have a thickness which is thick enough to receive the thickest one of the window sash frames or the door sash frames coupled to the insides thereof, the window frames or the door frames of the sliding doors and the door windows or the doors may be configured to have the same width and thickness, and the first transverse curtain wall connection members and the second transverse curtain wall connection members may be configured to have a height and thickness equal to the width and thickness of the window frames or the door frames for improvement in unification of the elevations thereof.

Advantageous Effects

The present invention provides a connective installation structure for modularized windows and doors in which sliding windows and door windows or doors are successively arranged and connectively installed in the horizontal direction with fixed windows arranged in spaces therebetween and a simplified double frame support structure in which a connective structure lateral-sectional view of a frame, formed by the elevations of elements forming the connective installation structure of windows and doors, includes only (window glass or door panel)-window sash frame-window frame-(fixed window glass), is provided.

Further, the connective installation structure for windows and doors in accordance with the present invention may provide unification in elevations of installed elements when the windows and doors of various standards and kinds are connectedly installed, form a slim elevation by eliminating or minimizing use of a curtain wall bar, and thus provide good aesthetic appearance and secure a widely open view.

In addition, the connective installation structure for windows and doors in accordance with the present invention may allow finishing work around the windows and doors to be easily performed by suppressing use of the curtain wall bar installed in the longitudinal direction and thus improve convenience and economical efficiency in operations, and maintain structural stability in terms of wind pressure resistance and control of vibration due to impact as compared to conventional structures including longitudinal curtain wall bars.

DESCRIPTION OF DRAWINGS

FIG. 1) and plan states (transverse-sectional views: FIG. 2) representing change between a closed state and an open state of a conventional modularized sliding window.

FIG. 3) and sectional states (tilt opening longitudinal-sectional views: FIG. 4) representing change between a closed state and an open state of a conventional modularized inward opening door window.

FIG. 5) and sectional states (tilt opening longitudinal-sectional views: FIG. 6) representing change between a closed state and an open state of a conventional modularized outward opening door window.

MODES OF THE INVENTION

Figure 1:
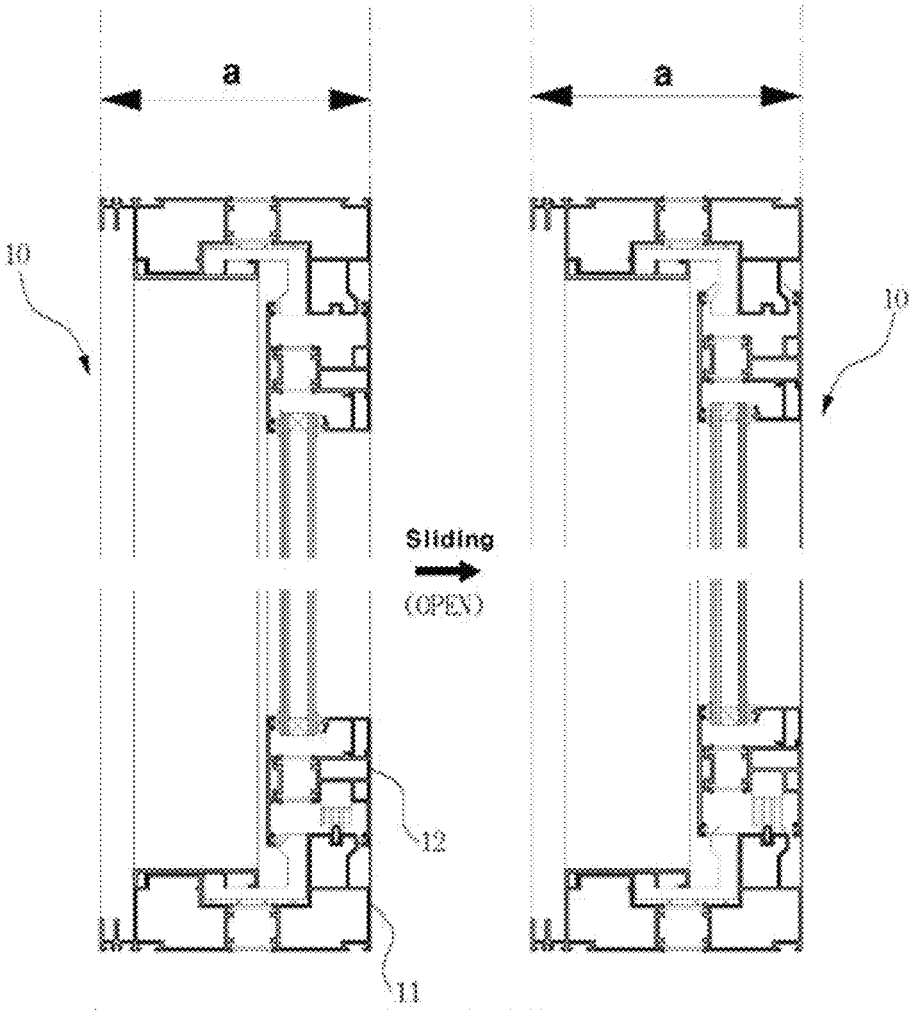
Figure 1 [Prior Art]
FIGS. 1 and 2 are views illustrating sectional states (longitudinal-sectional views.
Figure 2:
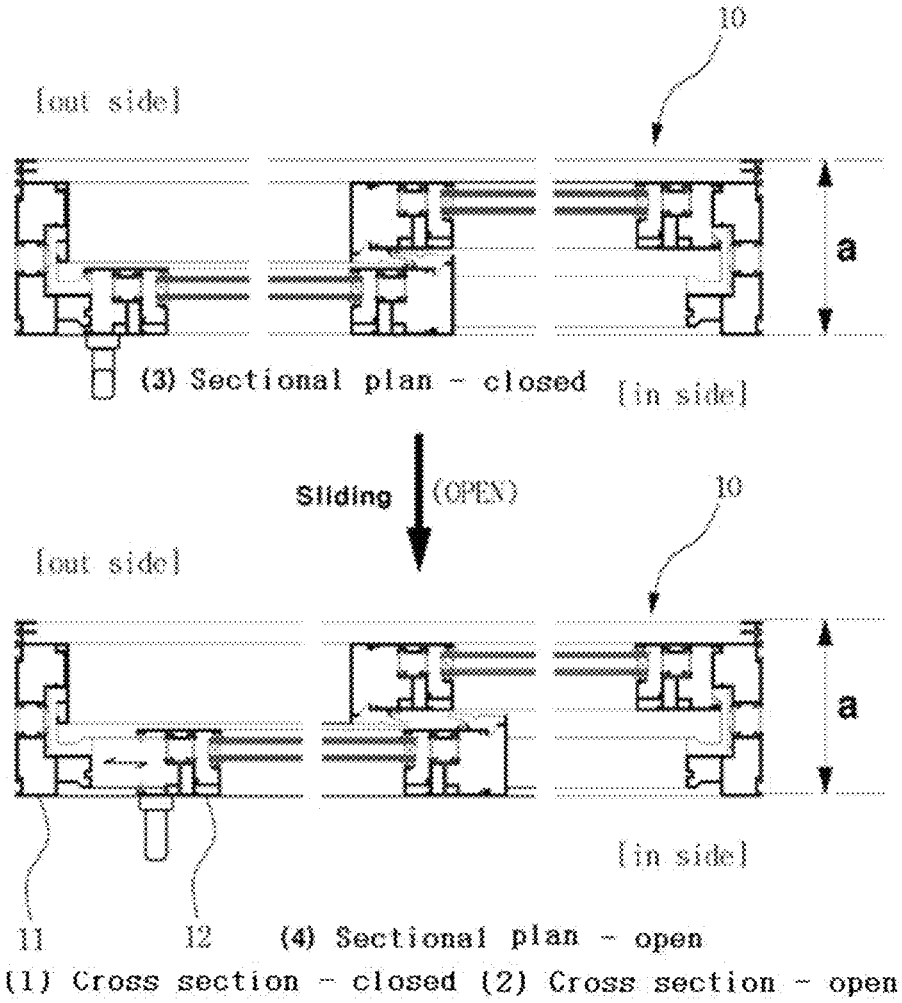
Figure 2 [Prior Art]
Figure 3:
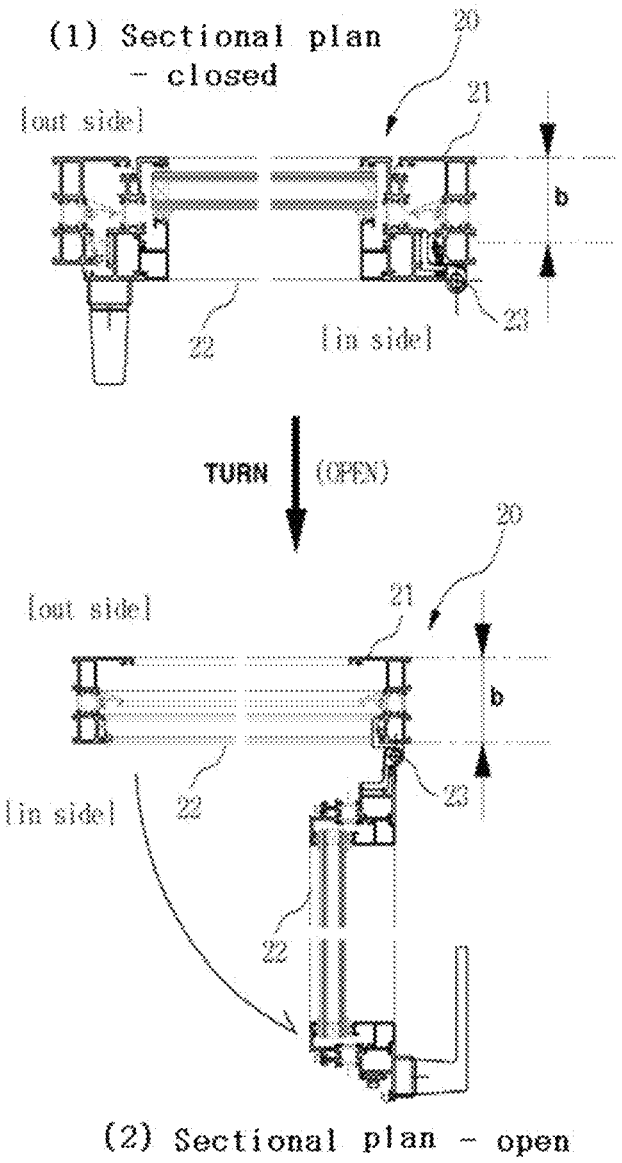
Figure 3 [Prior Art]
FIGS. 3 and 4 are views illustrating plan states (turn opening transverse-sectional views.
Figure 4:
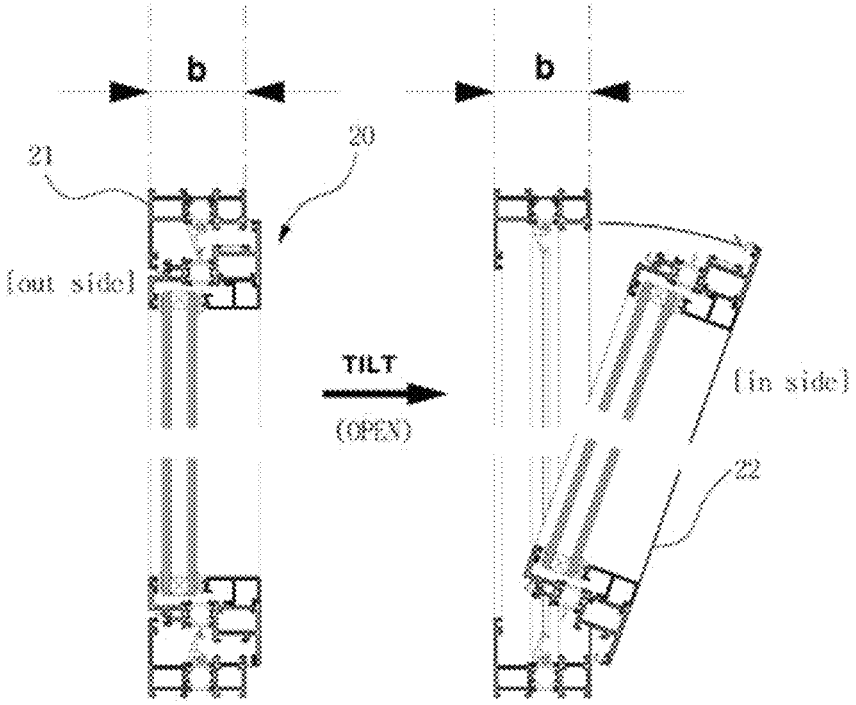
Figure 4 [Prior Art]
Figure 5:
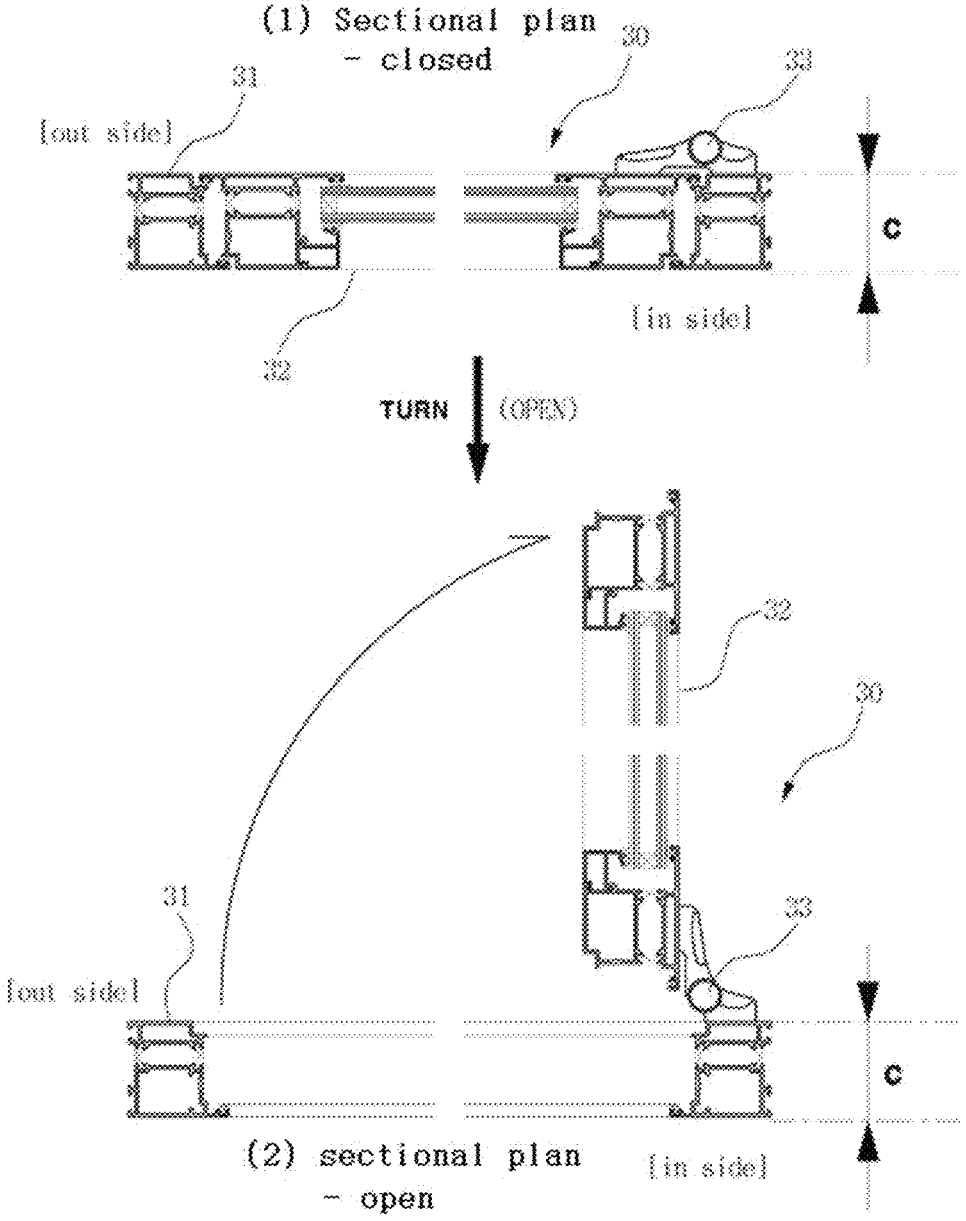
Figure 5 [Prior Art]
FIGS. 5 and 6 are views illustrating plan states (turn opening transverse-sectional views.
Figure 6:
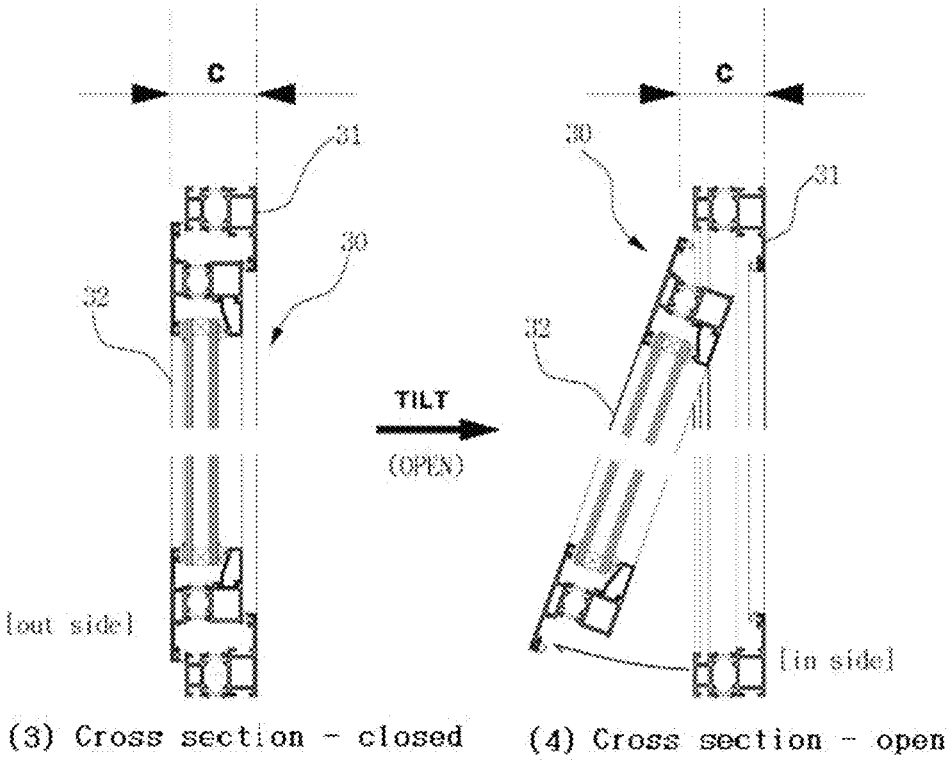
Figure 6 [Prior Art]
Figure 7:
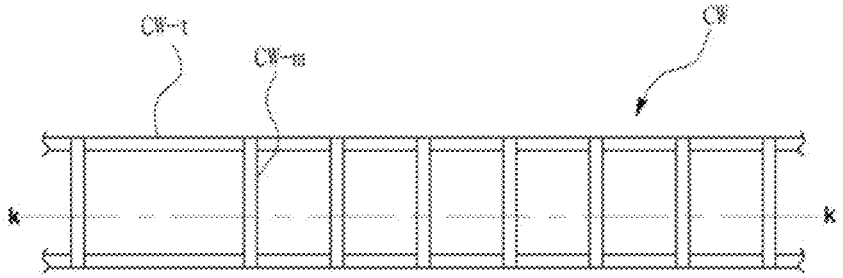
Figure 7 [Prior Art]
FIG. 7 is a front view of a pre-installed frame (blind frame) to successively arrange the conventional modularized sliding windows and door windows in the horizontal direction.
Figure 8:
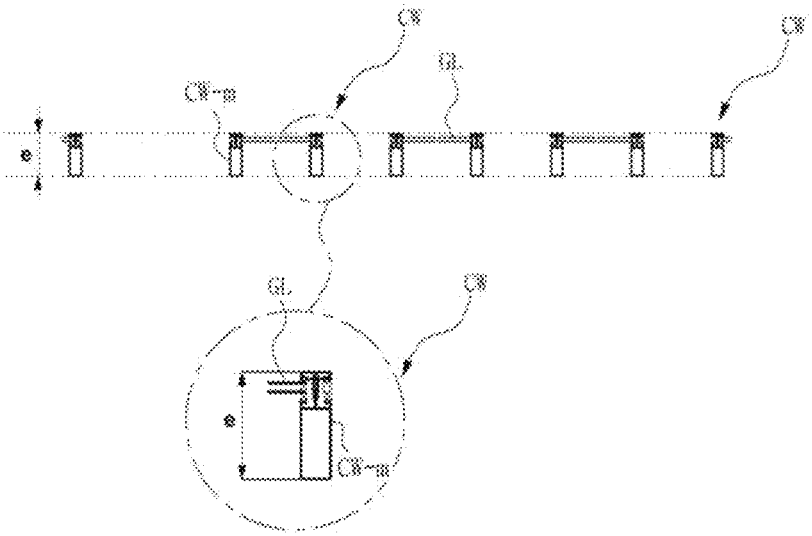
Figure 8 [Prior Art]
FIG. 8 is a transverse-sectional view of a curtain wall bar in which glass is installed in a frame.
Figure 9:
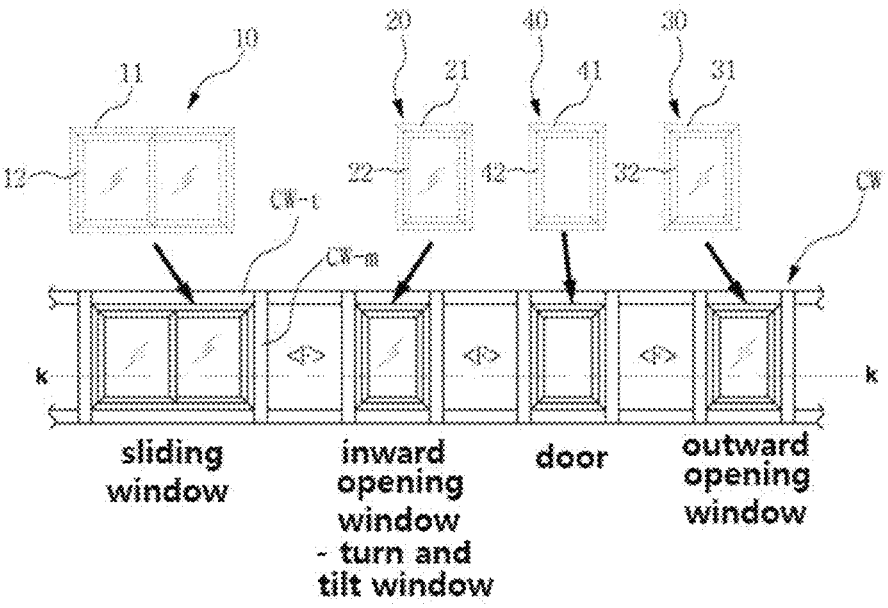
Figure 9 [Prior Art]
FIGS. 9 and 10 are front and transverse-sectional views illustrating successive arrangement of the conventional modularized sliding windows and door windows in the horizontal direction which are inserted into the frame (curtain wall bar).
Figure 10:
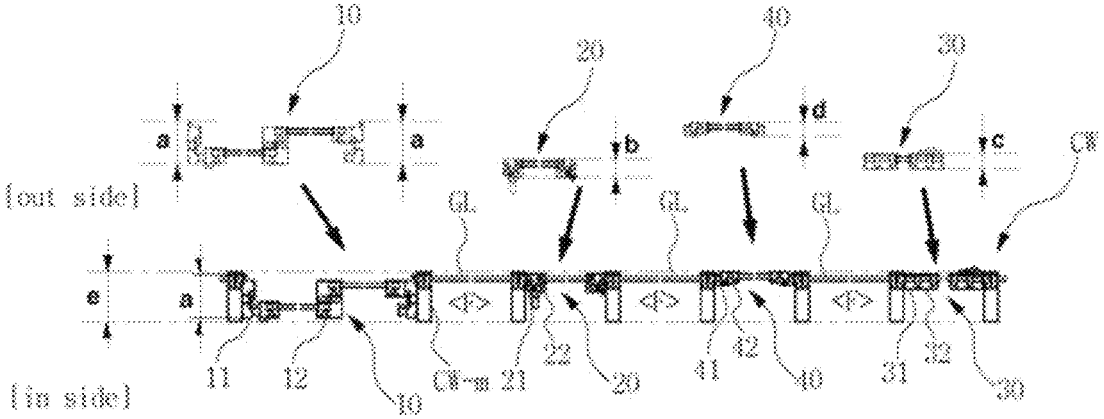
Figure 10 [Prior Art]

Hereinafter, exemplary embodiments of the present invention will be described in detail with reference to the accompanying drawings in order to enable those of skilled in the art which the present invention pertains to easily embody and practice the invention. However, the present invention is not limited to the exemplary embodiments disclosed below but can be implemented in various forms.

In accordance with one embodiment of the present invention, as exemplarily shown in FIGS. 11 to 25, in a connective installation structure for modularized windows and doors, in which modularized sliding windows 100 and door windows 200 and 300 or doors 400 used for exit and entrance access are successively arranged and connectively installed in the horizontal direction with fixed windows <F> arranged in spaces therebetween, glass side surface installation units 114, 214, 314, and 414 configured to fixedly install side surface parts of window glass GL of the fixed windows <F> installed in the spaces between the sliding windows 100 and the door windows 200 and 300 or the doors 400 are directly provided on transverse outer surfaces of window frames 110, 210, and 310 or door frames 410 forming outer perimeters of window sash frames 120, 220, and 320 or door sash frames 420 constituting the sliding doors 100 and the door windows 200 and 300 or the doors 400, first transverse curtain wall connection members 510 and second transverse curtain wall connection members 520 configured to respectively fix upper ends and lower ends of the window glass GL of the fixed windows <F> installed in the spaces between the sliding windows 100 and the door windows 200 and 300 or the doors 400 are provided, fixing parts 500 configured to fixedly connect the first transverse curtain wall connection members 510 and the second transverse curtain wall connection members 520 to upper end parts and lower end parts of the transverse outer surfaces of the window frames 110, 210, and 310 or the door frames 410 forming the outer perimeters of the window sash frames 120, 220, and 320 or the door sash frames 420 are provided, and glass upper and lower part installation units 514 and 524 configured to fixedly install upper and lower parts of the window glass GL of the fixed windows <F> installed in the spaces between the sliding windows and the door windows or the doors on lower surfaces of the first transverse curtain wall connection members 510 and upper surfaces of the second transverse curtain wall connection members 520 are provided.

Here, the window frames 110, 210, and 310 or the door frames 410 of the sliding windows 100 and the door windows 200 and 300 or the doors 400 may be set to have a thickness e which is thick enough to receive the thickest one of the window sash frames 120, 220, and 320 or the door sash frames 420 coupled to insides thereof, the window frames 110, 210, and 310 or the door frames 410 of the sliding windows 100 and the door windows 200 and 300 or the doors 400 may be configured to have the same width f and thickness e, and the first transverse curtain wall connection members 510 and the second transverse curtain wall connection members 520 may have a height f and thickness e equal to the width f and thickness e of the window frames 110, 210, and 310 or the door frames 410, for improvement in unification of the elevations thereof.

Figure 12:
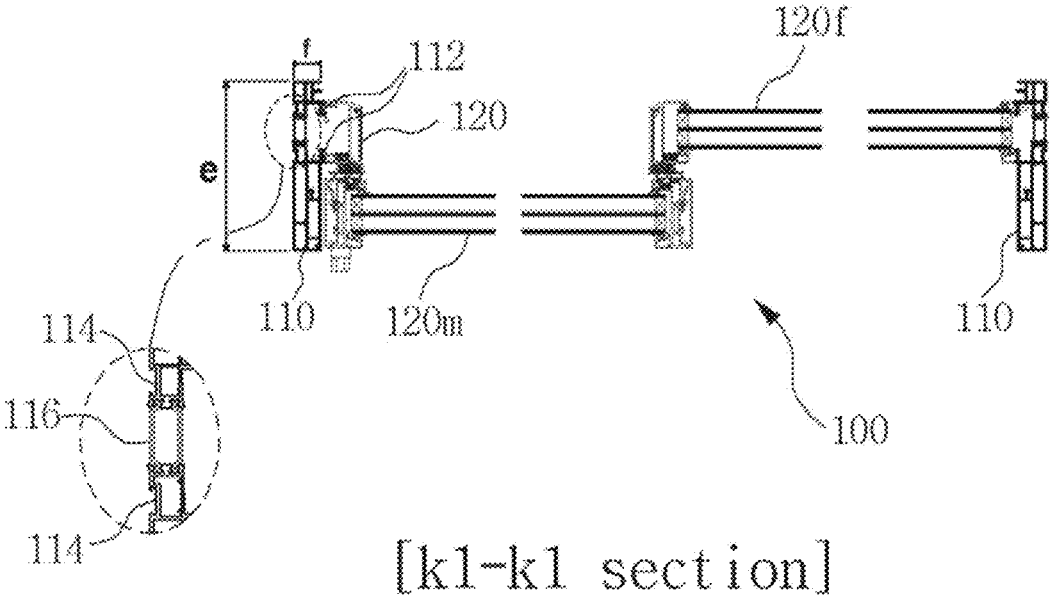
FIG. 12 is a transverse-sectional view (illustrating a k1-k1 section) of a sliding window part in a connective installation structure for modularized windows and doors in accordance with one embodiment of the present invention shown in FIG. 11.
Figure 13:
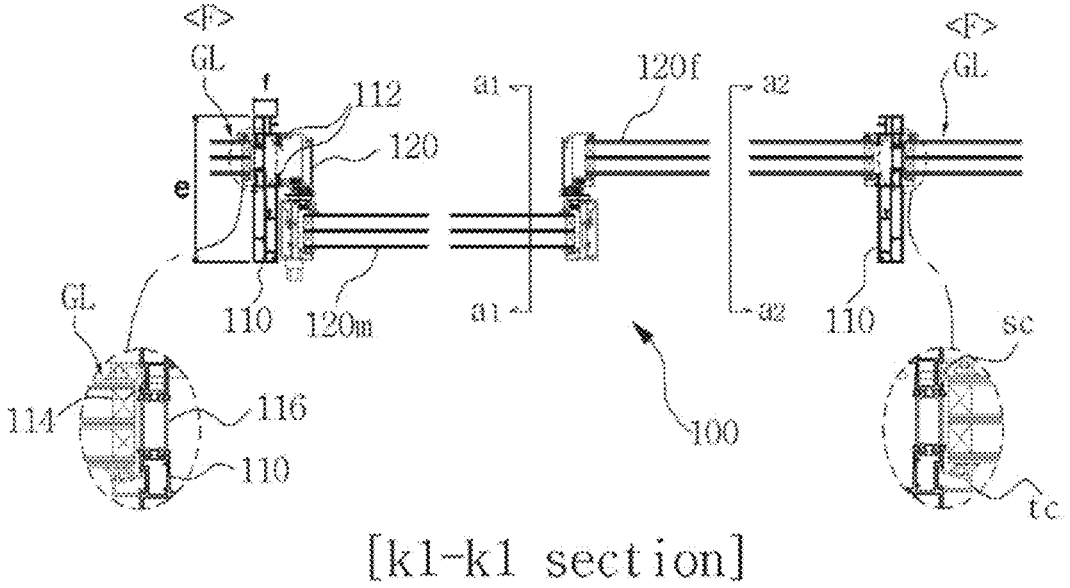
FIG. 13 is an enlarged view illustrating direct coupling of window glass (GL) to glass side surface installation units of a side surface part of the window frame shown in FIG. 12.
Figure 14:
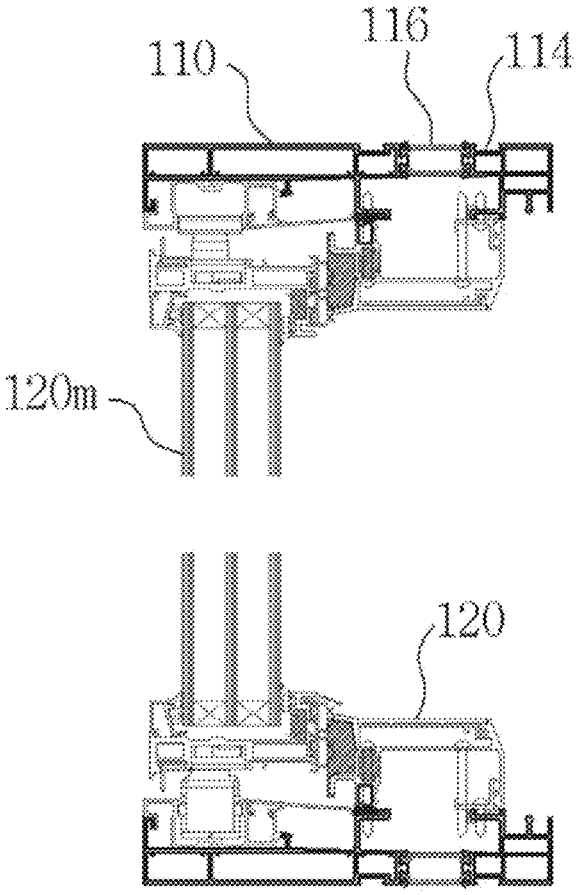
FIG. 14 is a longitudinal-sectional view taken along line a1-a1 of a movable window part of the sliding window of FIG. 13.
Figure 15:
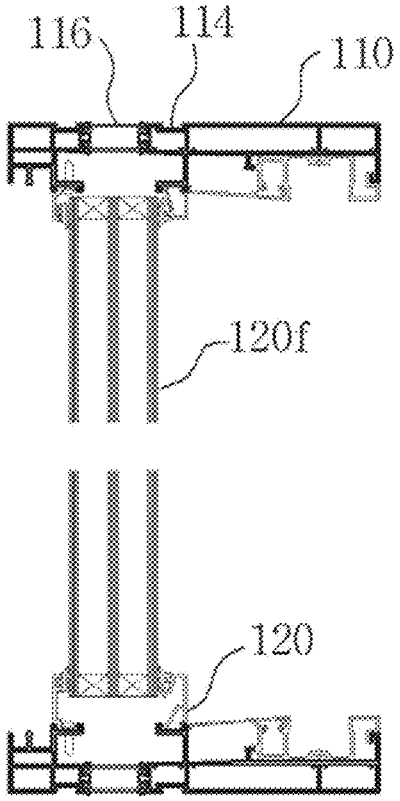
FIG. 15 is a longitudinal-sectional view taken along line a2-a2 of a fixed window part of the sliding window of FIG. 13.
Figure 16:
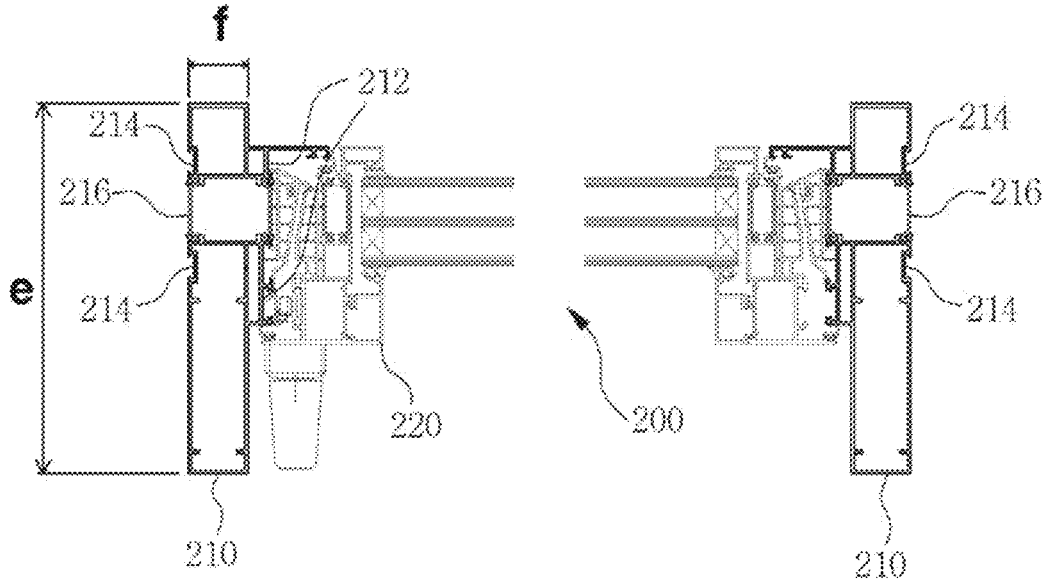
FIG. 16 is a transverse-sectional view (illustrating a k2-k2 section) of an inward opening door window part in the connective installation structure for modularized windows and doors in accordance with one embodiment of the present invention shown in FIG. 11.
Figure 17:
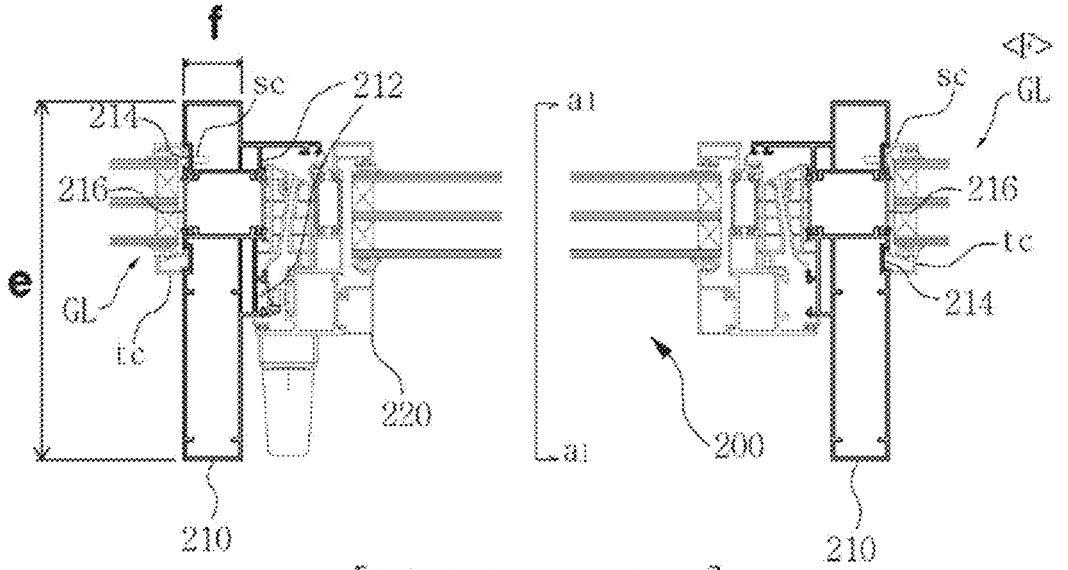
FIG. 17 is a view illustrating direct coupling of window glass (GL) to glass side surface installation units of a side surface part of the window frame shown in FIG. 16.
Figure 18:
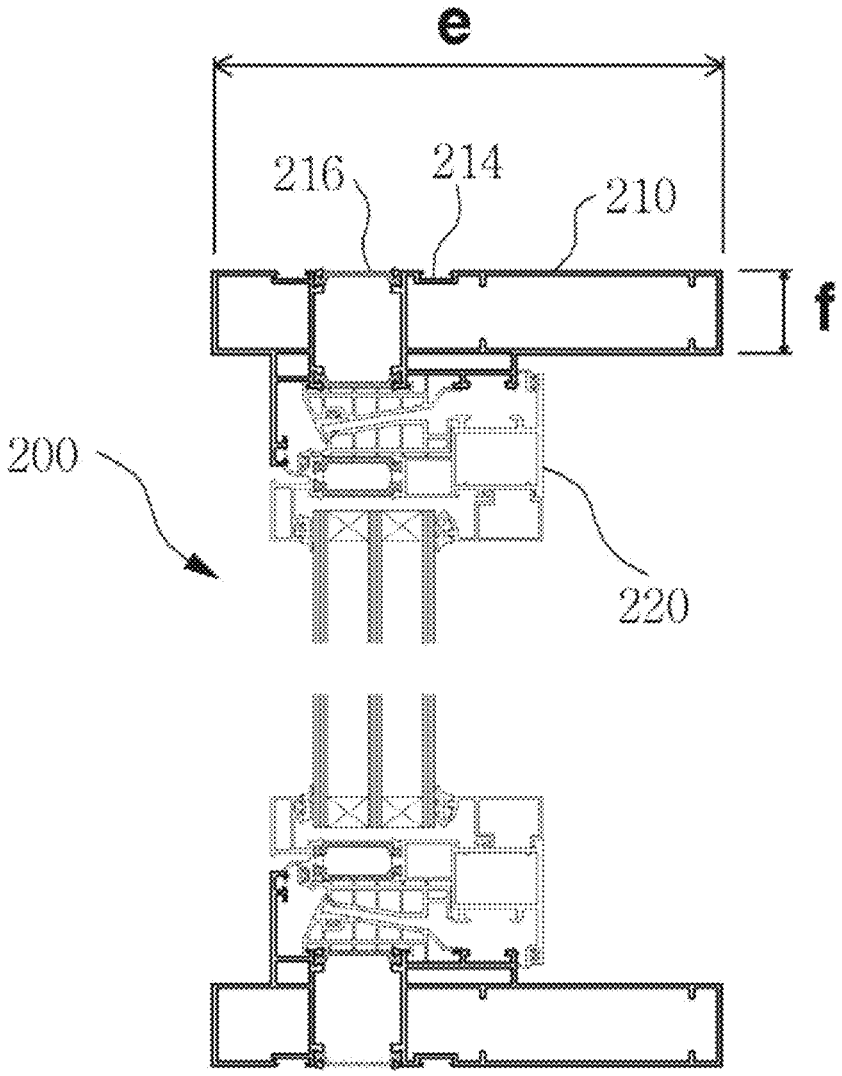
FIG. 18 is a longitudinal-sectional view taken along line a1-a1 of the door window part of FIG. 17.
Figure 19:
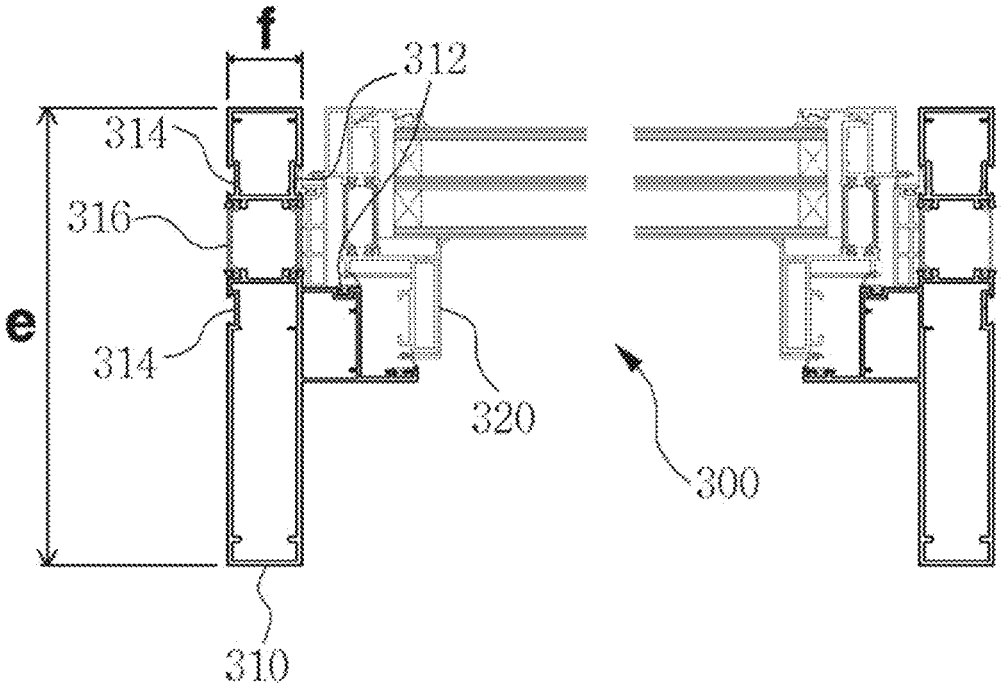
FIG. 19 is a transverse-sectional view (illustrating a k3-k3 section) of an outward opening door window part in the connective installation structure for modularized windows and doors in accordance with one embodiment of the present invention shown in FIG. 11.
Figure 20:
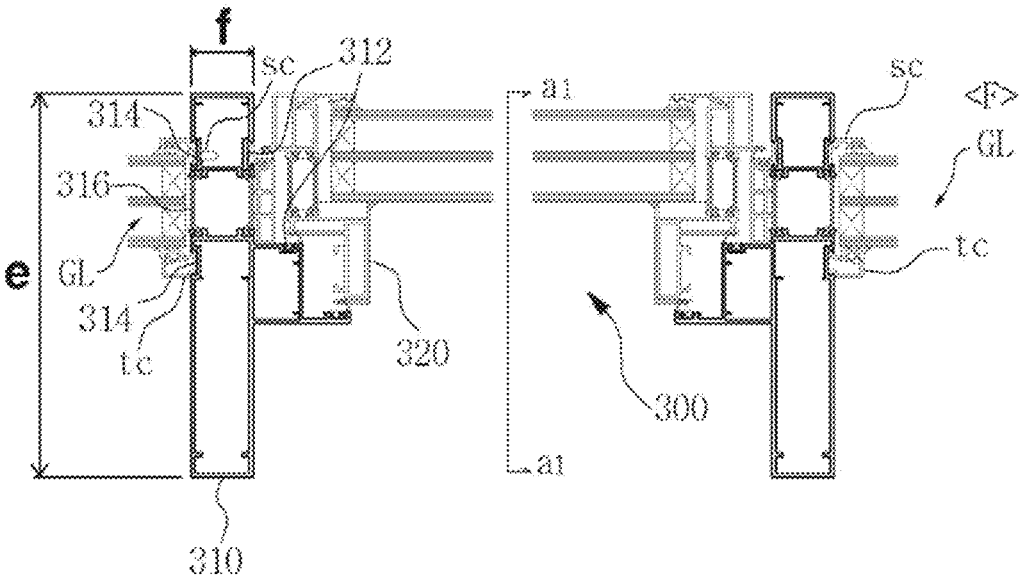
FIG. 20 is a view illustrating direct coupling of window glass (GL) to glass side surface installation units of a side surface part of the window frame shown in FIG. 19.
Figure 21:
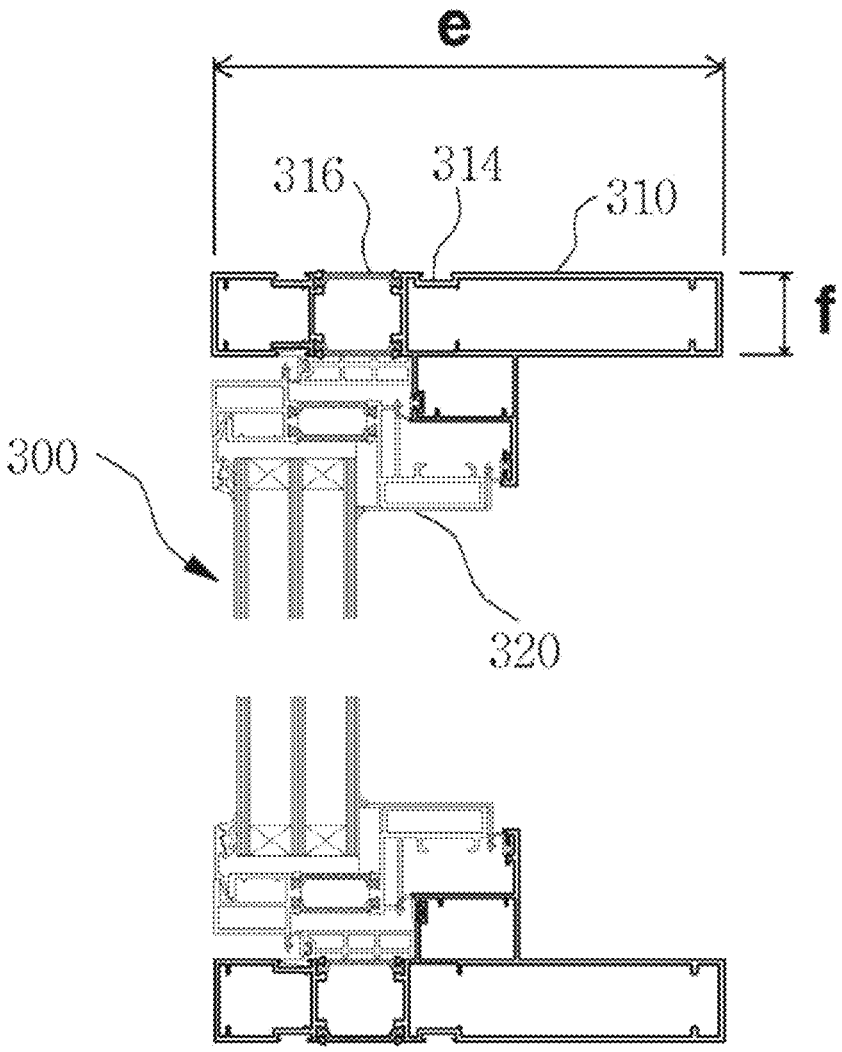
FIG. 21 is a longitudinal-sectional view taken along line a1-a1 of the outward opening door window part of FIG. 20.
Figure 22:
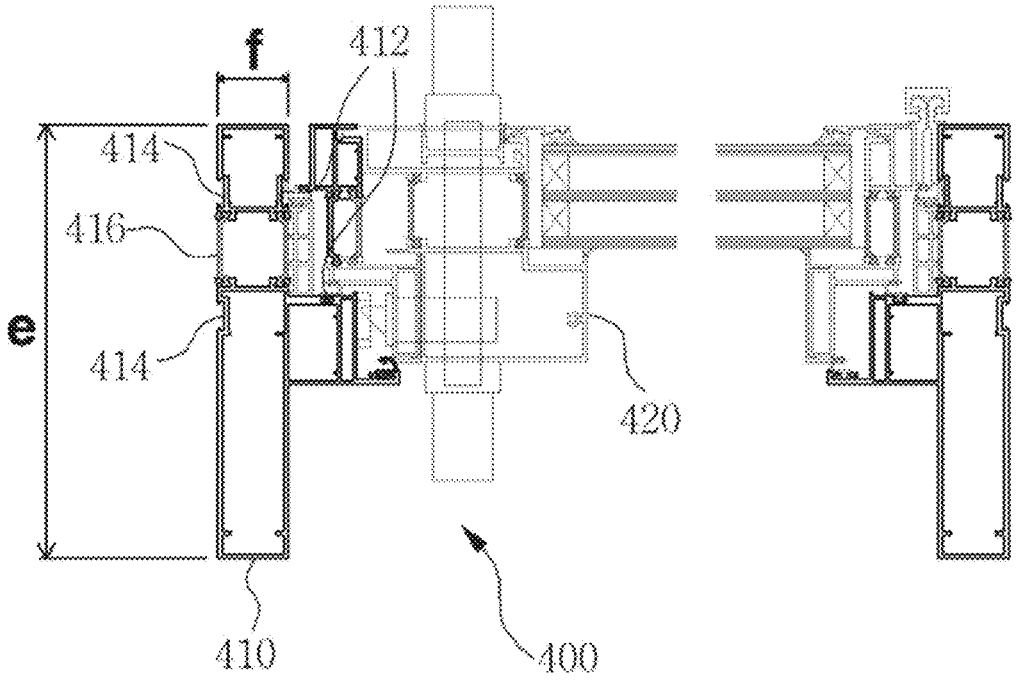
FIG. 22 is a transverse-sectional view (illustrating a k4-k4 section) of a door part used for exit and entrance in the connective installation structure for modularized windows and doors in accordance with one embodiment of the present invention shown in FIG. 11.
Figure 23:
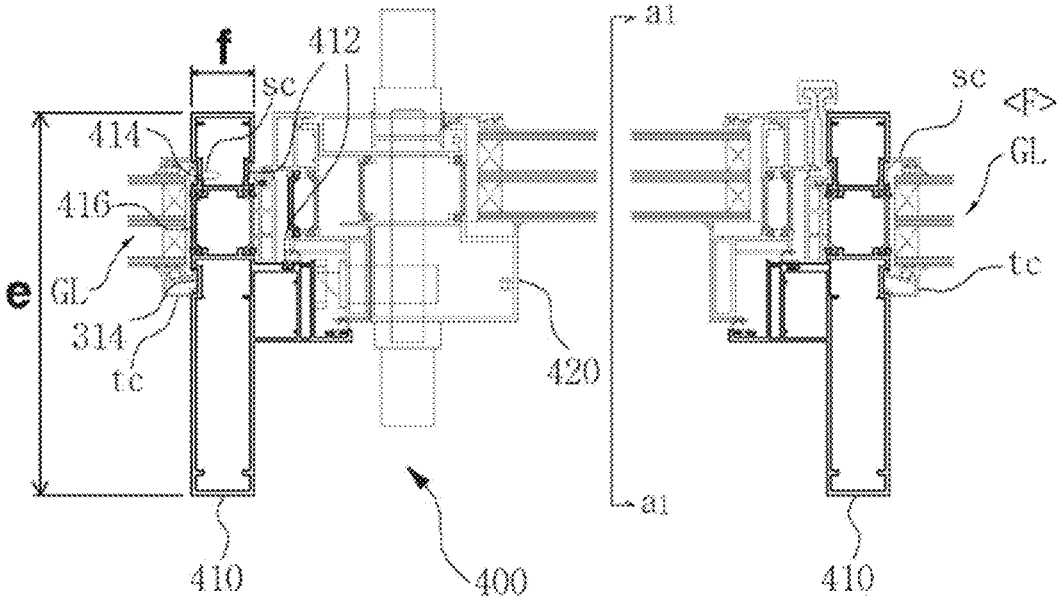
FIG. 23 is a view illustrating direct coupling of window glass (GL) to glass side surface installation units of a side surface part of the door frame shown in FIG. 22.
Figure 24:
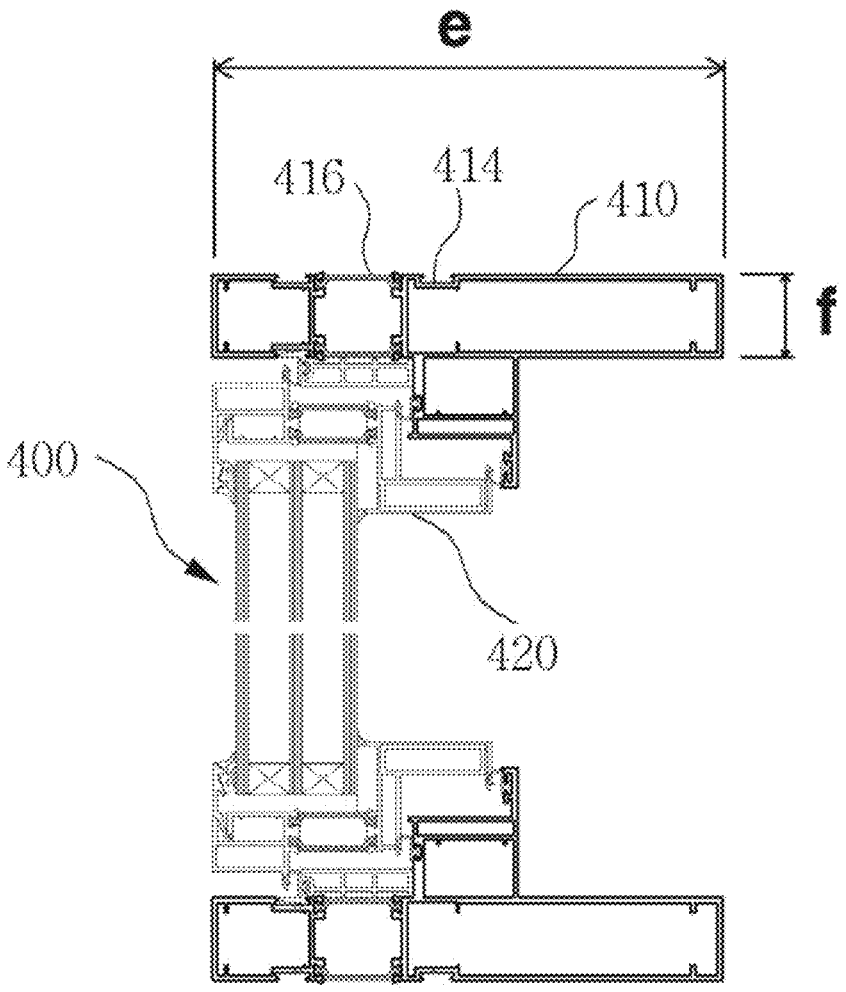
FIG. 24 is a longitudinal-sectional view taken along line a1-a1 of the door part of FIG. 23.

Further, in accordance with the present invention, the glass side surface installation units 114, 214, 314, and 414 provided on the outer surfaces of the window frames 110, 210, and 310 or the door frames 410 are provided on the transverse outer surfaces of the window frames 110, 210, and 310 or the door frames 410 and may be provided as grooves so that fixed clips sc and elastic clips tc to fix front surfaces and rear surfaces of the window glass GL may be fixedly inserted thereinto, as exemplarily shown in FIGS. 12 and 13 illustrating the sliding-type window 100 provided with a fixed window sash 120*f* and a movable window sash 120*m*, FIGS. 16 and 17 illustrating the inward opening door window 200, FIGS. 19 and 20 illustrating the outward opening door window 300, and FIGS. 22 and 23 illustrating the door 400, and, particularly, thermal breaking members 116, 216, 316, and 416 formed of plastic may be additionally inserted into spaces between 2 grooves constituting the glass side surface installation units 114, 214, 314, and 414 for improvement in heat insulation properties of a window and door system.

Comparatively referring to FIGS. 12, 16, 19, and 22, in accordance with the present invention, couplers 112, 212, 312, and 412 having various shapes corresponding to structural differences among various kinds of the window sash frames 120, 220, and 320 or the door sash frames 420 coupled to the insides of the window frames 110, 210, and 310 or the door frames 410 are provided on inner surfaces of the window frames 110, 210, and 310 or the door frames 410.

Figure 11:
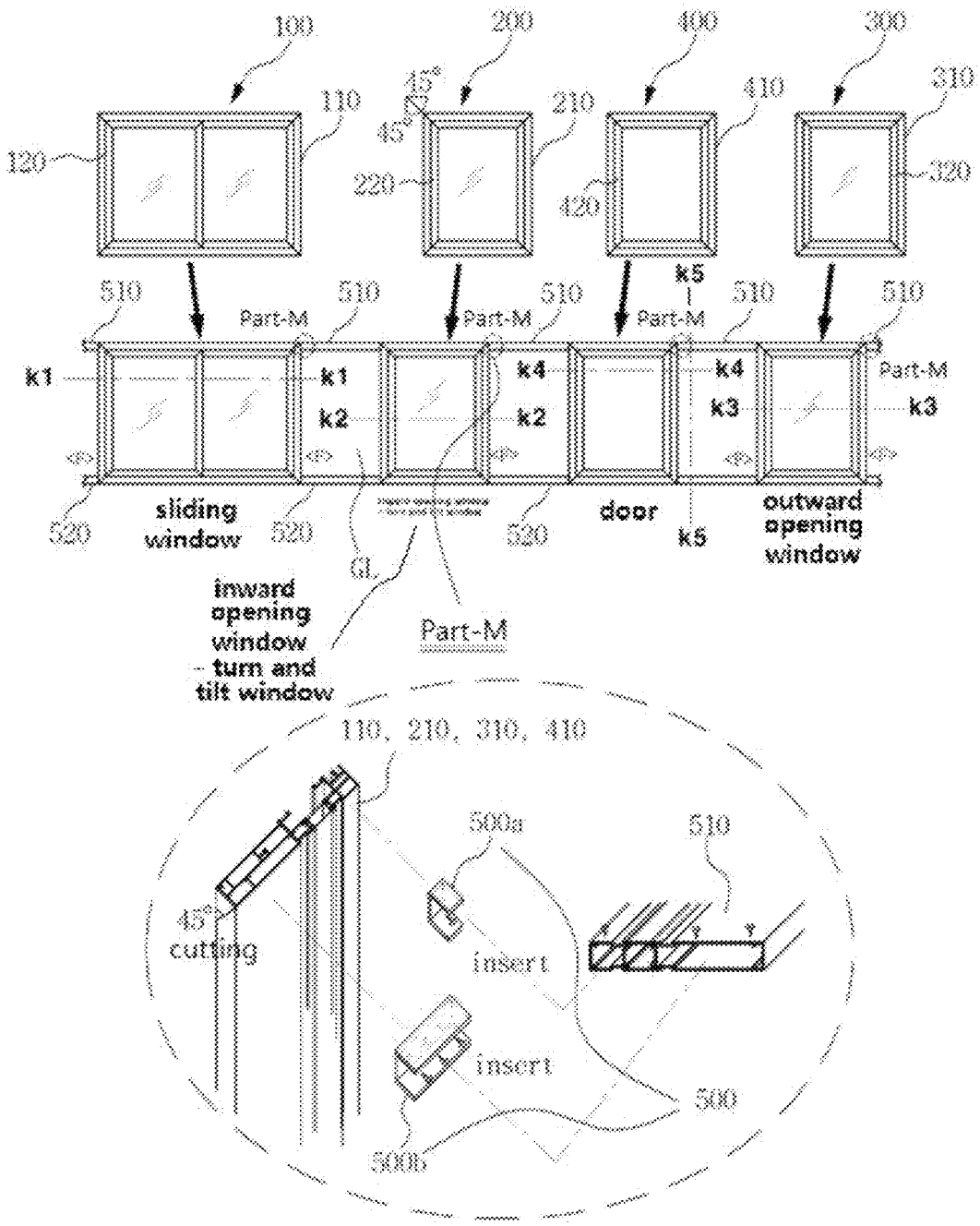
FIG. 11 illustrates a front view illustrating successive arrangement of modularized sliding windows and door windows or doors by respectively connecting upper and lower ends of side surfaces of window frames or door frames thereof by first and second transverse curtain wall connection members in accordance with one embodiment of the present invention, and an enlarged exploded perspective view of a connection part (M) thereof.

Further, describing an overall structure in accordance with one embodiment of the present invention in more detail with reference to the accompanying drawings, upper and lower end parts of the side surfaces of the window frames 110, 210, and 310 or the door frames 410 of the modularized sliding windows 100 and door windows 200 and 300 or doors 400 are respectively connected by the first and second transverse curtain wall connection members 510 and 520 to be successively arranged in the horizontal direction, as exemplarily shown in FIG. 11, coupling guides 500*a* and 500*b* serving as fixing units 500 may be installed at connection parts Part-M of the upper and lower end parts of the side surfaces of the window frames 110, 210, and 310 or the door frames 410, and the coupling guides 500*a* and 500*b* may be inserted into cross-sections of the first and second transverse curtain wall connection members 510 and 520 and be fixedly coupled thereto through screws, etc.

Respective installation states of the modularized sliding windows 100, door windows 200 and 300 and doors 400 exemplarily shown in FIG. 11 may be confirmed through a k1-k1 section state, a k2-k2 section state, a k3-k3 section state, and a k4-k4 section state shown in FIG. 11, i.e., sectional views of FIGS. 12 and 13, FIGS. 16 and 17, FIGS. 19 and 20, and FIGS. 22 and 23.

As described above, FIGS. 12 and 13 are transverse-sectional views (illustrating a k1-k1 section) of a sliding window 100 part provided with the fixed window sash 120*f* and the movable window sash 120*m*, and FIG. 13 illustrates direct coupling of the window glass GL of the neighboring fixed window <F> to the glass side surface installation units 114 provided as grooves on the side surface part of the window frame 110 forming the outer perimeter of the window sash frame 120 through the fixing clips sc and the elastic clips tc, in contrast to FIG. 12 except for the window glass. The movable window sash 120*m* and the fixed window sash 120*f* of the sliding window 100 having the above configuration are installed as exemplarily shown in FIGS. 14 and 15 which are a longitudinal-sectional view (illustrating an a1-a1 section) of a movable window part and a longitudinal-sectional view (illustrating an a2-a2 section) of a fixed window part.

Further, FIGS. 16 and 17 are transverse-sectional views (illustrating a k2-k2 section) of an inward opening door window 200 part, and FIG. 17 illustrates direct coupling of the window glass GL of the neighboring fixed window <F> to the glass side surface installation units 214 provided as grooves on the side surface part of the window frame 210 forming the outer perimeter of the window sash frame 220 through the fixing clips sc and the elastic clips tc, in contrast to FIG. 16 except for the window glass. The inward opening door window 200 having the above configuration is installed as exemplarily shown in FIG. 18 which is a longitudinal-sectional view (illustrating an a1-a1 section) thereof.

Further, FIGS. 19 and 20 are transverse-sectional views (illustrating a k3-k3 section) of an outward opening door window 300 part, and FIG. 20 illustrates direct coupling of the window glass GL of the neighboring fixed window <F> to the glass side surface installation units 314 provided as grooves on the side surface part of the window frame 310 forming the outer perimeter of the window sash frame 320 through the fixing clips sc and the elastic clips tc, in contrast to FIG. 19 except for the window glass. The outward opening door window 300 having the above configuration is installed as exemplarily shown in FIG. 21 which is a longitudinal-sectional view (illustrating an a1-a1 section) thereof.

In addition, a transverse-sectional installation state of the periphery of the door 400 used for exit and entrance provided between the inward opening door window 200 and the outward opening door window 300, as exemplarily shown in FIG. 11, may be described through transverse-sectional views (illustrating a k4-k4 section) of FIGS. 22 and 23, and FIG. 23 illustrates direct coupling of the window glass GL forming the fixed window <F> to the glass side surface installation units 414 provided as grooves on the side surface part of the door frame 410 forming the outer perimeter of the door sash frame 420 through the fixing clips sc and the elastic clips tc, in contrast to FIG. 22 except for the window glass. The door 400 having the above configuration is installed as exemplarily shown in FIG. 24 which is a longitudinal-sectional view (illustrating an a1-a1 section) thereof.

Figure 25:
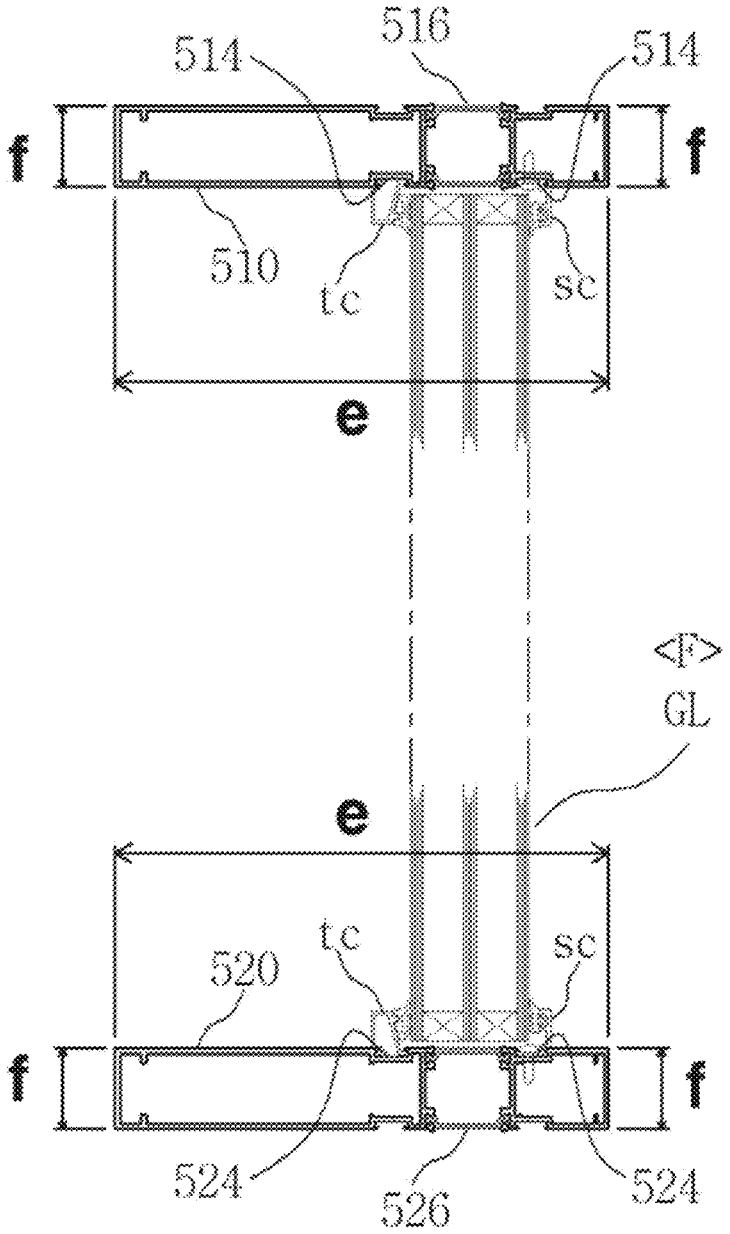
FIG. 25 is a longitudinal-sectional view (illustrating a k5-k5 section) of the second transverse curtain wall connection member connecting the upper and lower ends of the side surface of the window frame or the door frame in the connective installation structure for modularized windows and doors in accordance with one embodiment of the present invention shown in FIG. 11.

Further, as exemplarily shown in FIG. 25, the glass upper and lower part installation units 514 and 524 provided on lower surfaces of the first transverse curtain wall connection members 510 and upper surfaces of the second transverse curtain wall connection members 520 may be provided as 2 grooves to fixedly receive the fixing clips sc and the elastic clips tc supporting the front and rear surfaces of the window glass GL and, particularly, thermal breaking members 516 and 526 formed of plastic may be additionally inserted into spaces between the 2 grooves constituting the glass upper and lower part installation units 514 and 524 for of improvement in heat insulation properties of the window and door system.

As described above through the enlarged view of the connection part Part-M of FIG. 11, both end parts of the first transverse curtain wall connection members 510 and the second transverse curtain wall connection members 520 applied to one embodiment of the present invention are combined with the upper and lower end parts of the side surfaces of the window frames 110, 210, and 310 or the door frames 410 through the coupling guides 500*a* and 500*b* provided as the fixing units 500.

Further, the window frames 110, 210, and 310 or the door frames 410 provided with the glass side surface installation units 114, 214, and 314 or 414 provided as grooves on the transverse outer surfaces thereof may be used at the outer perimeters of upper and lower window sash frames 120, 220, and 320 or door sash frames 420 for uniformity of members during a process of applying the connective installation structure for modularized windows and doors in accordance with the present invention to windows and doors constructed on walls of an actual building and, in this case, both ends thereof connected to each other are cut at an angle of 45° so as to form a rectangular frame as exemplarily shown in FIG. 11.

Further, those skilled in the art will appreciate that, according to situations of a construction site, the respective window frames and the first transverse curtain wall connection members 510 and the second transverse curtain wall connection members 520 arranged therebetween may be primarily connected to form an overall window and door assembly and then the window and door assembly may be integrally constructed on a wall surface of a building, or, otherwise, a sequential assembly method, in which, for example, in the rightward direction from the left, one window frame (for example, the window frame 110 of the sliding window) and the first transverse curtain wall connection member 510 and the second transverse curtain wall connection member 520 connected thereto are primarily constructed, and then the window frame 210 of another window (for example, the inward opening door window) and the first transverse curtain wall connection member 510 and the second transverse curtain wall connection member 520 arranged at the right side thereof are constructed, may be used.

Although a few embodiments of the present invention have been disclosed for illustrative purposes, those skilled in the art will appreciate that various modifications, additions, and substitutions are possible without departing from the scope and spirit of the invention as disclosed in the accompanying claims.

The invention claimed is:

1. A connective installation structure for modularized windows and doors, which is formed by successively arranging and connectively installing modularized sliding windows (100) and door windows (200, 300) or doors (400) for exit and entrance in the horizontal direction with fixed windows (<F>) arranged in spaces therebetween, wherein:

glass side surface installation units (114, 214, 314, 414) configured to fixedly install side surface parts of window glass (GL) of the fixed windows (<F>) installed in the spaces between the sliding windows (100) and the door windows (200, 300) or the doors (400) are directly provided on transverse outer surfaces of window frames (110, 210, 310) or door frames (410) forming outer perimeters of window sash frames (120, 220, 320) or door sash frames (420) constituting the sliding windows (100) and the door windows (200, 300) or the doors (400);

first transverse curtain wall connection members (510) and second transverse curtain wall connection members (520) configured to respectively fix upper ends and lower ends of the window glass (GL) of the fixed windows (<F>) installed in the spaces between the sliding windows (100) and the door windows (200, 300) or the doors (400) are provided between the transverse outer surface of window frame (110) of the sliding windows (100) and the transverse outer surface of window frame (210, 310) of the door windows (200, 300) or the transverse outer surface of door frame (410) of the doors (400);

fixing units (500) configured to fixedly connect the first transverse curtain wall connection members (510) and the second transverse curtain wall connection members (520) to upper end parts and lower end parts of the transverse outer surfaces of the window frames (110, 210, 310) or the door frames (410) forming the outer perimeters of the window sash frames (120, 220, 320) or the door sash frames (420) are provided; and glass upper and lower part installation units (514, 524) configured to fixedly install upper and lower parts of the window glass (GL) of the fixed windows (<F>) installed in the spaces between the sliding windows and the door windows or the doors on lower surfaces of the first transverse curtain wall connection members (510) and upper surfaces of the second transverse curtain wall connection members (520) are provided.

2. The connective installation structure for modularized windows and doors of claim 1:

wherein the window frames (110, 210, 310) or the door frames (410) of the sliding windows (100) and the door windows (200, 300) or the doors (400) have insides; and wherein the window frames (110, 210, 310) or the door frames (410) of the sliding windows (100) and the door windows (200, 300) or the doors (400) are set to have a thickness (e) which is thick enough to receive the thickest one of the window sash frames (120, 220, 320) or the door sash frames (420) coupled to the insides thereof, the window frames (110, 210, 310) or the door frames (410) of the sliding windows (100) and the door windows (200, 300) or the doors (400) are configured to have the same width (f) and thickness (e), and the first transverse curtain wall connection members (510) and the second transverse curtain wall connection members (520) are configured to have a height (f) and thickness (e) equal to the width (f) and thickness (e) of the window frames (110, 210, 310) or the door frames (410).

3. The connective installation structure for modularized windows and doors of claim 1, wherein the glass side surface installation units (114, 214, 314, 414) provided on the outer surfaces of the window frames (110, 210, 310) or the door frames (410) are provided on the transverse outer surfaces of the window frames (110, 210, 310) or the door frames (410) and provided as grooves so that fixed clips (sc) and elastic clips (tc) configured to fix front surfaces and rear surfaces of the window glass (GL) may be fixedly inserted thereinto.

4. The connective installation structure for modularized windows and doors of claim 3, wherein thermal breaking members (116, 216, 316, 416) are additionally inserted into spaces between 2 grooves constituting the glass side surface installation units (114, 214, 314, 414).

5. The connective installation structure for modularized windows and doors of claim 3:

wherein the window frames (110, 210, 310) or the door frames (410) have insides;

wherein couplers (112, 212, 312, 412) having shapes corresponding to structural differences among various kinds of the window sash frames (120, 220, 320) or the door sash frames (420) are coupled to the insides of the window frames (110, 210, 310) or the door frames (410); and wherein the couplers (112, 212, 312, 412) are provided on inner surfaces of the window frames (110, 210, 310) or the door frames (410).

6. The connective installation structure for modularized windows and doors of claim 3, wherein coupling guides (500*a*, 500*b*) serving as fixing units (500) are installed at connection parts of the upper and lower end parts of the side surfaces of the window frames (110, 210, 310) or the door frames (410), and the coupling guides (500*a*, 500*b*) are inserted into cross-sections of the first and second transverse curtain wall connection members (510, 520) and thus fixedly coupled thereto.

7. The connective installation structure for modularized windows and doors of claim 3, wherein the glass upper and lower part installation units (514, 524) provided on lower surfaces of the first transverse curtain wall connection members (510) and upper surfaces of the second transverse curtain wall connection members (520) are provided as 2 grooves to fixedly receive the fixing clips (sc) and the elastic clips (tc) supporting the front and rear surfaces of the window glass (GL), and thermal breaking members (516, 526) are additionally inserted into spaces between the 2 grooves constituting the glass upper and lower part installation units (514, 524).

* * * * *